United States Patent [19]

Crawford et al.

[11] Patent Number: 4,744,415

[45] Date of Patent: May 17, 1988

[54] KICKOVER TOOL FOR PLACING AND REMOVING WELL FLOW CONTROL DEVICES

[76] Inventors: Douglass W. Crawford; William B. Crawford, both of P.O. Box 51, Atwood Akers, Crowley, La. 70526; Mark S. Crawford, 501 Kaiser Dr., LaFayette, La. 70508

[21] Appl. No.: 42,361

[22] Filed: Apr. 24, 1987

[51] Int. Cl.[4] ..... E21B 23/03
[52] U.S. Cl. ..... 166/117.5
[58] Field of Search ..... 166/117.5, 117.6

[56] References Cited

U.S. PATENT DOCUMENTS

| | | | |
|---|---|---|---|
| 3,268,006 | 8/1966 | Hayes | 166/117.5 |
| 3,796,259 | 3/1974 | Outhouse | 166/117.5 |
| 4,031,954 | 6/1977 | Herbert et al. | 166/117.5 |

FOREIGN PATENT DOCUMENTS

| | | | |
|---|---|---|---|
| 8603544 | 6/1986 | PCT Int'l Appl. | 166/117.5 |

*Primary Examiner*—James A. Leppink
*Assistant Examiner*—Hoang C. Dang
*Attorney, Agent, or Firm*—Dodge, Bush & Moseley

[57] ABSTRACT

In accordance with an illustrative embodiment of the present invention, a kickover tool for replacing and removing valves includes an orienting section having angularly spaced dogs that are cooperable with a sleeve in a side pocket mandrel to cause orientation of the tool and to trigger longitudinal movement of a control rod. Rod movement cams an inwardly biased kickover arm outwardly to enable extension of guides that cooperate with ramps or the like in the side pocket mandrel to cause a valve coupled to said kickover arm to be inserted through a seat and latched in place in the mandrel. After the valve is seated and latched, the guides are disabled wtih response to upward force on the pivot arm. A clutch to prevent premature actuation of the kickover tool also is disclosed.

17 Claims, 2 Drawing Sheets

FIG.1A
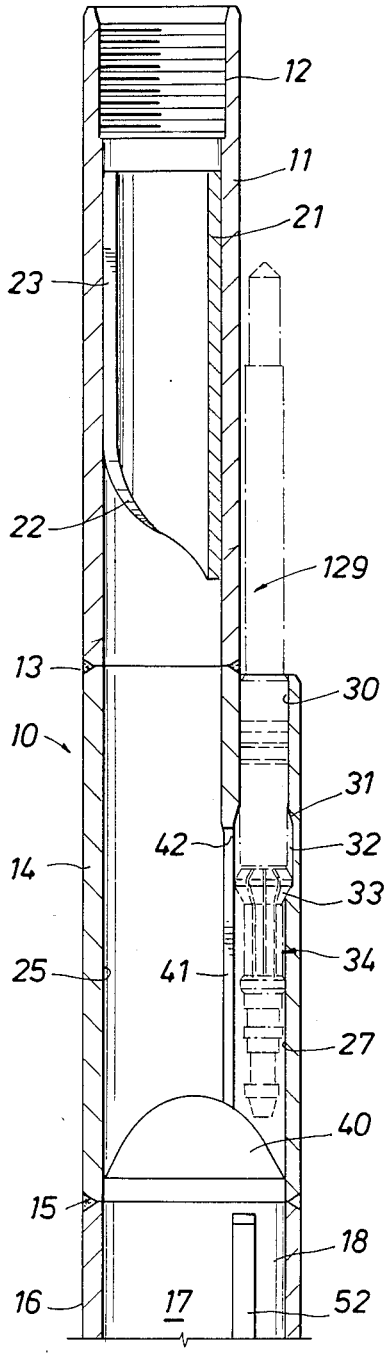
FIG.1B
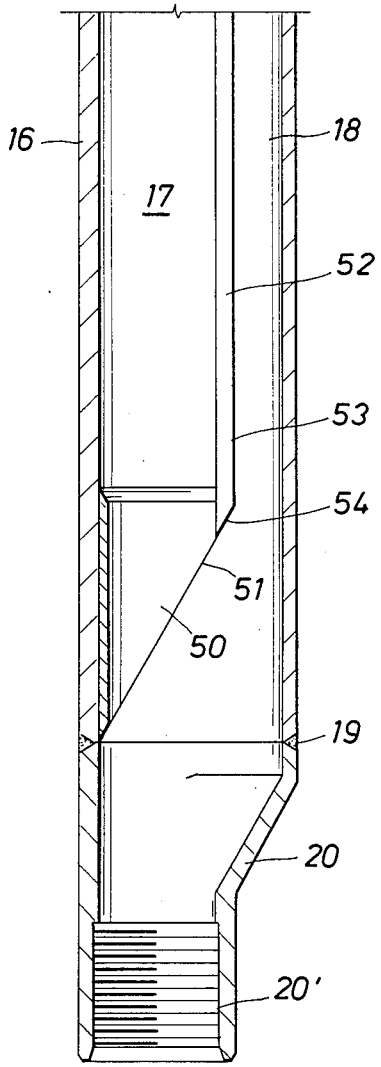
FIG.2A
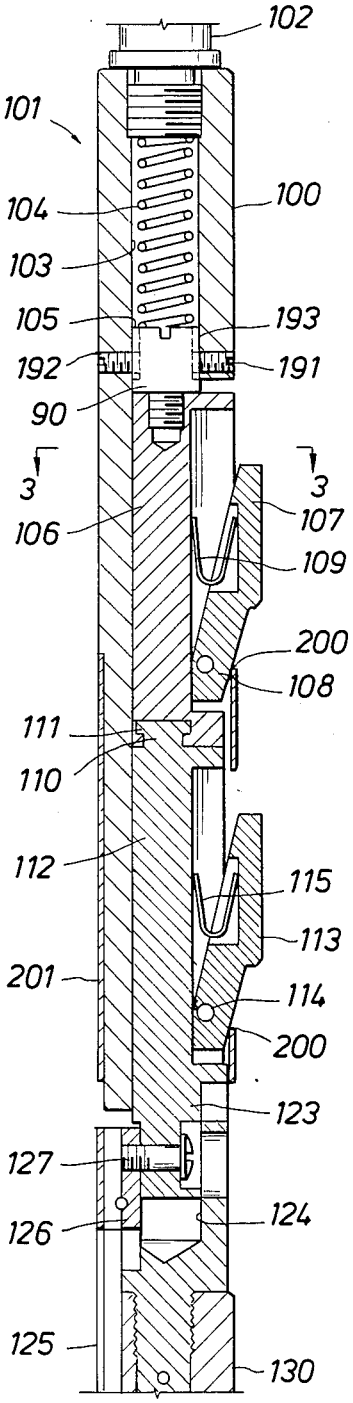
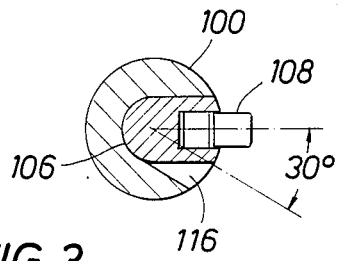
FIG.3

FIG. 2B
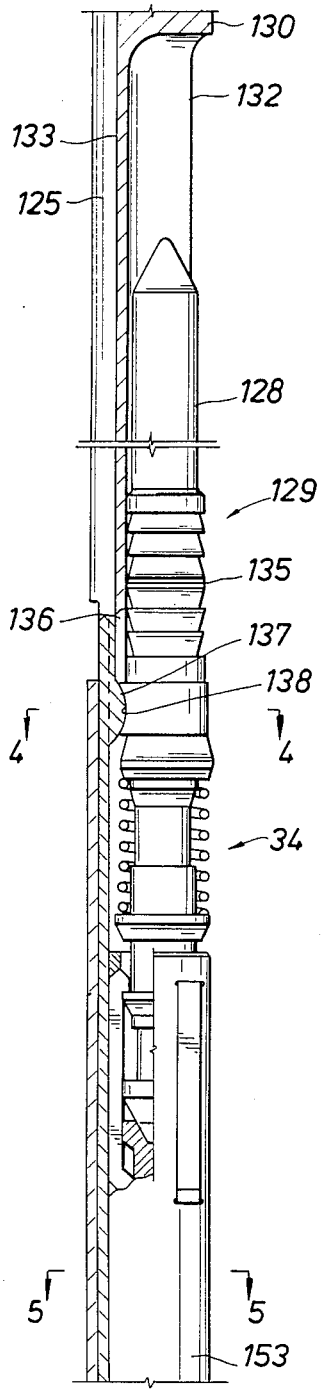
FIG. 2C
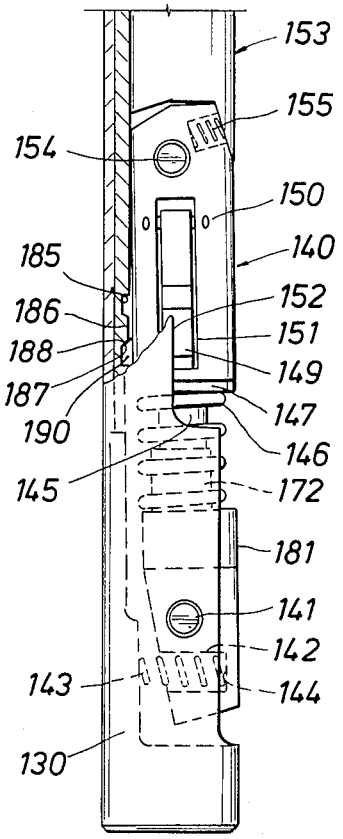
FIG. 6
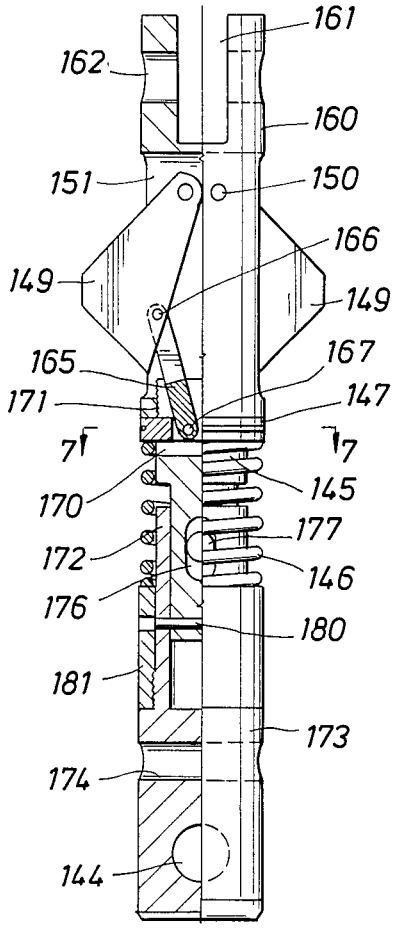
FIG. 4
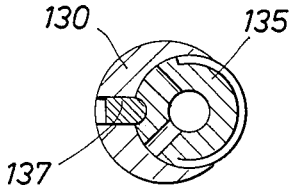
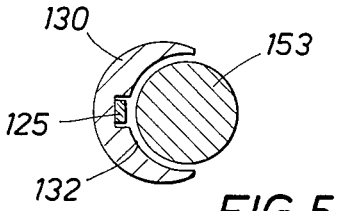
FIG. 5
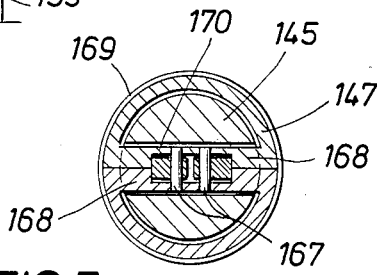
FIG. 7
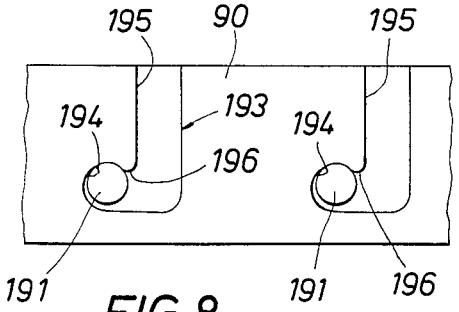
FIG. 8

KICKOVER TOOL FOR PLACING AND REMOVING WELL FLOW CONTROL DEVICES

FIELD OF THE INVENTION

The present invention relates generally to apparatus for placing or removing a well flow control device, such as a gas lift valve, in or from a side pocket mandrel in a well production string, and particularly to a new and improved kickover tool having an inwardly biased arm that carries normally retracted means for guiding a flow control device into a valve seat in a side pocket mandrel.

Other pending applications that are related to this application are application Ser. No. 679,263 filed Dec. 7, 1984, and Ser. No. 789,313 filed Oct. 18, 1985, U.S. Pat. No. 4,715,441.

BACKGROUND OF THE INVENTION

Wells having a production string of tubing that includes vertically spaced side pocket mandrels are used extensively in oil well production operations. Each of the mandrels generally includes an open-topped side pocket that is laterally offset to the side of the mandrel bore. A tool known as a "kick-over" tool is lowered through the tubing on wire line to the level of the mandrel to effect placement or removal of a flow control device in or from the side pocket. The device can be a gas lift valve that includes a dome pressure operated regulator valve, or a "dummy" valve that blocks off the mandrel flow ports, which is held in the pocket by a latch assembly that engages a shoulder above the top of the pocket.

The kickover tools of the prior art are generally activated by pulling dogs on the tool up against a shoulder in the mandrel to release the kickover arm that carries the flow control device. The arm is biased outwardly so that its outward movement aligns the bottom nose of the device with the side pocket of the mandrel. Downward movement and jarring are then used to insert the flow control device into the side pocket and to release the arm from the latch which engages underneath a shoulder to hold the device in the pocket. Since the kickover arm and flow control device are biased outwardly, there is always a considerable risk of the tool being prematurely activated which can cause it to drag and hang up in the tubing.

The general object of the present invention is to provide a new and improved kickover tool having an inward biased arm assembly to provide more reliable and improved operations, such arm having guide means that can be extended to cause outward movement of the arm assembly as the kickover tool is moved upward in the tubing.

SUMMARY OF THE INVENTION

This and other objects are attained in accordance with the present invention through the provision of a kickover tool including an upper body that carries a pair of outwardly biased dogs or keys that are vertically spaced and are mounted for relative angular movement. A tray connected to the lower end of the body has an inwardly biased pivot arm connected to its lower end, and the upper end of the arm is releasably coupled to a running or pulling tool that is coupled to the latch assembly of a flow control device, so that the arm and device normally are positioned alongside the tray as the assembly is being run. The pivot arm carries a pair of normally retracted elements, such as guide wings, that when extended on opposite sides of the arm can engage a ramp surface in the side pocket mandrel and cause the arm and flow control device to pivot outwardly into alignment with the valve seat in the mandrel. The extension of these elements is under the control of a release rod which extends upwardly through the tray to the vicinity of the lower door or key on the upper body.

The keys are rotated relative to one another to a misaligned position as the kickover tool is prepared for insertion into the tubing, and such misalignment causes the release rod, which is spring loaded, to function to enable the pivot arm to remain in its inner position. As the tool is lowered into the tubing, the keys can pivot inwardly to pass through the orienting sleeves in the various side pocket mandrels, or any other restrictions, that are above the mandrel in which the flow control device is to be set. When the kickover tool reaches the target mandrel, it is lowered to a position just below this mandrel, and then is raised upwardly into it. The upper one of the keys will engage helical surfaces on the orienting sleeve and automatically "find" the vertical slot thereiin, and in so doing, rotationally orient the tool so that the pivot arm and flow control device are in a predetermined orientation within the mandrel. When the lower key engages one of the helical surfaces on the lower end of the orienting sleeve, the keys are forced to rotate relative to one another into vertical alignment, which releases the control rod for downward movement under the influence of a coil compression spring. Such downward movement cams the pivot arm outwardly somewhat with respect to the tray, which enables outward movement of one or more normally extended wings on the pivot arm. In extended positions, the wings engage the guide means in the lower portion of the mandrel during continued upward movement of the kickover tool. Such movement results in general alignment of the flow control device with its seat, so that upward movement inserts the device through the seat until a single packing element thereon engages the seat. A latch assembly on the flow control device engages a shoulder to stop the device, whereupon a jarring force can be applied to shear pins to release the arm assembly from the latch mechanism, and to disable the wings so that they are no longer normally extended. The kickover tool is then lowered, and the arm assembly pivots inwardly to enable the tool to be removed from the well, leaving the flow control device in place.

BRIEF DESCRIPTION OF THE DRAWINGS

The present invention has other objects, features, and advantages which well become more clearly apparent in connection with the following detailed description of a preferred embodiment, taken in conjunction with the appended drawings in which:

FIGS. 1A and 1B are longitudinal sectional news of a side pocket mandrel in which the kickover tool of the present invention can be used to place or remove a flow control device, FIG. 1B forming a lower continuation of FIG. 1A;

FIGS. 2A–2C are longitudinal sectional news, with some portions in side elevation, of the kickover tool of the present invention;

FIG. 3 is a cross-section on line 3—3 of FIG. 2A, and FIGS. 4 and 5 are cross-sections on lines 4—4 and 5—5 of FIG. 2B.

FIG. 6 is a longitudinal sectional view, with portions in side elevation, of the pivot arm assembly of the present invention showing the wings in their normally extended position;

FIG. 7 is a cross-section on lines 7—7 or FIG. 6; and

FIG. 8 is a developed plan view of a clutch mechanism used in the present invention.

DETAILED DESCRIPTION OF A PREFERRED EMBODIMENT

Referring initially to FIGS. 1A and 1B, a side pocket mandrel, designated generally by the numeral 10, is arranged to be connected in a well tubing which leads upwardly to the surface. There may be several of the mandrels 10 located at vertically spaced points in the tubing, and of course the tubing is located inside of a well casing (not shown) which lines the well bore. Typically a packer (not shown) anchors the lower end of the tubing in the casing, and seals off the annulus between the tubing and the casing so that pressurized gas can be injected therein at the surface to effect gas lift operations. The mandrel 10 includes an upper tubular member 11 having internal threads 12 for connecting the same to the string of production tubing. The tubular member 11 can be secured by a transverse weld 13 to a seating section 14 of relatively short length, and the section 14 may be secured by a transverse weld 15 to a main body section 16. The main body section 16 preferably is circular in cross-section, and one side 17 of the hollow interior thereof is axially aligned with the bore of the tubular member 11. The other side 18 of the hollow interior provides an elongated space for operation of the kickover arm of a gas lift valve setting or retrieving tool of the present invention, such arm typically being a segmented subassembly that can be pivoted outward in order to align a valve attached to the end thereof for insertion into a valve seat or pocket in the mandrel. The lower end of the main body section 16 can be secured by a transverse weld 19 to a swage nipple 20 that has internal threads 20' for connection tothe tubing. Although a welded construction is shown, other means for securing the members is end-to-end relationship can be used.

As shown in FIG. 1A, the tubular member 11 has an orienting sleeve 21 fixed within the bore thereof. The sleeve 21 has a pair of helical lower surfaces 22 that lead upward to an elongated vertical slot 23. The slot 23 is arranged to receive the keys on the setting tool as it is moved upward therethrough, in order to rotationally orient the tool in a manner such that the kickover arm and valve are properly aligned within the body section 16. Such orientation is achieved by the fact that the upper key will first encounter one of the inclined surfaces 22 and be guided thereby into the slot 23. A second key that initially is vertically misaligned with the first-mentioned key will then encounter one of the surfaces 22 during continued upward movement, and the camming action that is produced as the keys are forced into vertical alignment achieves final orientation and causes the kickover tool to trigger the release of the guide wings on the arm assembly. The wings then cause the inwardly biased arm assembly to be pivoted outward during continued upward movement.

The seating section 14 is generally tubular, and has a main bore 25 machined to one side thereof. The upper end of the bore 25 opens through an annular lip which is chamfered to facilitate welding to the lower end of the tubular member 11. Another bore 27 is formed on the opposite side of the section 14, and has its central axis inclined downward and inward with respect to the axis of the man bore 25. The angle of inclination may be, for example, from $1\frac{1}{2}°$ to 3°. the upper end portion 30 of the bore 27 has a reduced diameter (for example 1.125 inches), and is machined as a polish bore that is adapted to receive an annular packing assembly of a gas lift valve as shown in phantom lines in FIG. 1A. The bore 30 opens to the outside of the mandrel at its upper end, and is joined by an annular inclined surface 31 to a larger diameter bore 32 which receives the latch element (for example collet) of a typical latch assembly 34 which releasably secures the gas lift valve, or other flow control device, in place. The latch element has shoulder surfaces that engage an inclined shoulder 33 at the lower end of the enlarged bore 32, and the shoulder 33 s at the upper end of the bore 27 that opens through thelower end surfaces 40 of the section 14.

The surface 40 is generally frusto-conical as shown, and a vertical slot 41 is milled out inthe wall tha separates the bores 27 and 25 in oder to provide for the inward flow of lift gas. The slot 41 extends upward to a point 42 adjacent the "no-go" shoulder 31, and preferably has a width such that the latch shoulder 33 extends circumferentially through an angle of about 290° (145° to either side of a radial line that intersects the respective centerlines of the bores 25 and 32) to provide an ample stop surface area for the latch element. The slot 41 also functions as a guide for proper rotational orientation of the body of the gas lift valve to radially align a port in the neck of the valve such that the lift gas is injected into the bore 25 where it is admixed and entrained in the upward flow of production fluids.

The lower end of the body section 16, as shown in FIG. 1B, has fixed therein a ramp or guide member 50 that is generally semi-circular in cross-section and has inclined surfaces 51 on opposite sides thereof. The upper and lower ends of the member 50 can be oppositely inclined, as shown, so that no transverse shoulders are formed which could cause other tools to hang up on the member. If desired, a pair of oppositely disposed, elongated rails 52 are mounted inside the main body section 16 between the bore 17 and the region 18, in positions such that outwardly facing surfaces 53 are generally vertically aligned with the innermost surface of the seating bore 30. The lower end of each rail 52 may be inclined at 54 to present a continuous ramp surface, and the upper end of each rail can terminate at or near the upper end of the body section 16.

A preferred embodiment of the kickover tool of the present invention is shown in FIGS. 2A through 2C. The housing 100 of the orienting section 101 has a fishing neck 102 threaded into its upper end. The central bore 103 of the housing 100 receives a power spring 104 that pushes down on the upper end surface 105 of an element 90 that is screwed into the top end of the upper mandrel 106. The upper mandrel 106 has a key 107 pivoted thereto by a pin 108. A folded leaf spring 109 biases the key 107 outwardly. The lower end of the upper mandrel 106 is provided with a U-shaped recess 110 that receives a connector lug 111 on the upper end of a lower mandrel 112. The mandrel 112 carries a second key 113 that is pivoted on a pin 114 and is biased outward by a folded leaf spring 115. As shown in cross-section in FIG. 3, the upper mandrel 106 and the housing 100 can rotate relative to one another through an angle of about 30° due the width of the window opening 116 in the housing 100. The lower end portion 123 of the lower mandrel 112 is fitted into a bore 124 of the housing 100, and has a control rod 125 attached thereto by means of a connector block 126 and a screw 127.

The lower end of the housing 100 is threaded directly to the upper end of an elongated tray 130 as shown in FIGS. 2A and 2B. The tray 130 has an elongated internal recess 132 which receives the body 128 of a gas lift valve 129, as shown in phantom lines, and a rear recess 133 that receives the control rod 125. At the location of the packing sub 135 of the valve, a slot 136 can be cut into the rear of the tray 130, and a hump 137 can be provided on the rod 125 which engages in a recess 138 on the sub 135 to provide for a fixed rotational orientation of the packing sub 135 when th valve 129 is being run.

As shown in FIG. 2C, the lower end of a pivot arm assembly 140 is pivoted to the tray 130 by a pin 141. The arm 140 is biased toward an inner or retracted position by a coil spring 142 that reacts between an outwardly facing surface 143 on the tray and a back wall surface of a recess 144 in the arm below the pivot pin 141. The lower portion 145 of the arm 140 is surrounded by a coil spring 146 that presses upwardly on a drive ring 147 which is linked to a pair of oppositely extending wings 149 that are pivoted to the upper portion of the arm 140 by pins 150. The wings 149 are mounted in a transverse slot 151 in the upper body section and are spring biased to be normally extended as shown in FIG. 6. However, when the arm assembly 140 is in its inner position as shown in FIG. 2C, the wings 149 are held retracted within the slot 151 by side surfaces 152 on the opposite sides of the tray 130. The upper end of the pivot arm assembly 140 is connected to the lower end of a running or retrieving arm assembly 153 by a pivot pin 154. A compressed coil spring 155 reacts between respective arm surfaces and tends to hold the arm assembly 153 and the gas lift valve 25 within the tray recess 132.

The lower arm assembly 140 comprises an upper body member 160 having a slot 161 in its upper end that pivotably receives the lower end section of the upper arm assembly 153, the arms being secured to one another by the pivot pin 154 that extends through aligned holes 162. The elongated, traverse slot 151 is cut entirely through the central portion of the body member 160 and receives the pair of wings 149 that have their respective upper ends mounted on pivot pins 150 which are laterally offset to either side or the axial centerline of the body member 160. The wings 149 pivot about the respective pins 150 so as to occupy inner or retracted positions where the outermost portions thereon extends only slightly, if at all, beyond the peripheral outline of the body member 160, and extended positions as shown where such outer portions can slidably engage the outer surfaces 51 of the mandrel ramp 50 to cause outward pivotal movement of the upper end of the arm assembly 140 as the kickover tool is moved upward within the mandrel 10.

In order to control pivotal movement of the wings 149, a lower portion of each wing is coupled to a link 165 by means of a pivot pin 166. The lower end of each link 165 is coupled by another pin 167 to the drive ring 147. As shown in FIG. 7, the ring 147 can be a split assembly having diagonal webs 168, the two halves of the ring being held together by a circular clip 169 or other suitable device. The pins 167 are received in parallel aligned holes in the webs 168, which are recessed as shown to receive the lower ends of the links 165. The composite web 168 is slidably received in a transverse slot 170 formed in the lower section 145 of the upper body member 160, which is threaded thereto at 171. The lower body section 145 is telescopically received within a sleeve 172 that extends upward from the connector head 173 on the lower end of the pivot arm assembly 140. The head 173 has a transverse hole 174 to permit attachment to the tray 130 by the pivot pin 141, and a recess 144 located below the axis in the hole 174 to receive the outer ends of the compressed coil spring 142.

A vertically elongated slot 176 is provided in the lower body section 145, and is arranged to receive a short coupling rod 177 having ends that are received in diametrically opposed apertures 178 in the sleeve 172. Due to the elongation of the slot 176, a lost-motion connection is provided between the body section 145 and the sleeve 172, with upward movement of the sleeve being limited by engagement of the rod 177 with the top surface of the slot 176, and downward movement being limited by engagement with the bottom surface of the slot. A shear pin 180 releasably attaches the body section 145 to the sleeve 172 in a relative position such that the coil spring 146, which reacts between the upper end of a collar 181 on the sleeve 172 and the lower face of the drive ring 147, is compressed somewhat in order to urge the wings 149 to be pivoted outward by the links 165. In this position, the coupling rod 177 is below the upper end surface of the slot 176 a distance approximately equal to the diameter of the shear pin 180. In order to disable the wings 149 so that they are no longer normally extended, an upward impact blow can be applied to the connector head 173 and the sleeve 172 to disrupt the shear pin 180. When that occurs, the spring 146 can extend and relax as the rod 177 moves to the lower end of the slot 176, which also permits the drive ring 147 to move downward and cause retraction of the wings 149.

The wings 149 are released to assume their normally extended positions in response to downward movement of the control rod 125. As shown in FIG. 2C the lower end of the rod 125 has a recess 185 located above an enlargement 186 that has a downwardly and outwardly inclined lower surface 187. The surface 187 engages a companion inclined surface 188 on a rearwardly projecting lug 190 on the body section 160. When the control rod 125 is moved downward as previously described, the enlargement 186 cams the body section 160 outward so that the wings 149 are clear of the sides 152 of the tray 132. When this occurs, the drive spring 146 and the links 165 pivot the wings 149 outward. In the lower position of the rod 125, the recess 185 is opposite the lug 190, so that the pivot arm 140 can return to the position shown in FIG. 2C during retrieval of the kickover tool from the well.

OPERATION

In operation, a gas lift valve or other flow control device 129 is attached to the running arm 153 by the latch assembly 34, and the valve, running arm and pivot arm 140 are folded against the tray 130. The running arm 153 and the latch 34 are conventional structures well known to those skilled in the art, and need not be described here. The upper and lower mandrels 106 and 112 of the orienting section 101 are shifted upwardly against the bias of the power spring 104, and the upper mandrel 106 and key 107 are rotated to the left position the key out of alignment with the lower key 113, by about 30° as shown in FIG. 3. In this position a pair of oppositely directed pins 191 are inserted and secured in apertures 192 adjacent the member 90 as shown in FIG. 2A. The inner end of each pin 191 extends into a "jay-slot" 193 formed in the outer periphery of the member 90 and on opposite sides thereof. As shown in developed view in FIG. 8, each jay-slot 193 has a closed end section 194 that is connected to a vertical, open end section 195 by an inclined section 196. When the tool is "cocked" as previously described, the pins 191 are positioned to extend into the closed end section 194 to thereby retain the mandrels 106 and 112 and the control rod 125 in their upper positions. The manner in which the parts are released will be described below.

The kickover tool 101 is connected to the wire line by associated equipment such as sinker bar and a jar, and lowered into the tubing. As the keys 113 and 107 pass any restrictions that may be present in the tubing bore, they merely pivot inwardly to bypass such restrictions. When the mandrel 10 is reached in which it is desired to set the valve 129, the tool is lowered to a position below the mandrel and then lifted upward. As the upper key 107 encounters a lower helical surface 22 of the sleeve 21, the entire tool assembly 101 is rotated to a position such that the nose of the valve 25 initially is 30° to the right of the bore 27. Then as the tool is lifted further upward, the lower key 113 encounters a helical guide surface and begins to orient the valve nose toward vertical alignment with the bore 27. During initial relative rotation, the inclined sections 196 of the jay-slots 193 cause the pins 191 to lift the member 90 slightly, thus slightly compressing the power spring 104 even more, until the pins enter the open ended sections 195 of the slots, which are located 30° around from the sections 194. When this occurs, the power spring 104 forces the mandrels 106 and 112 and the control rod 125 downward. Such movement cams the lower pivot arm 140 outwardly so that the wings 149 are caused to extend laterally outwardly and outside the ramp sections 51 ofthe guide 50 in the mandrel 10.

Then as the tool is raised further upward, the wings 149 ride against the outer surfaces 51 and 53 to cause outward pivoting of the arm 140 against the bias afforded by the spring 142. Such pivotal movement shifts the arm 153 and the nose of the valve 129 into alignment with the bore 27, and the valve is inserted through the polish bore 30 until the packing sub 135 is seated therein, with the latch 34 engaging above the mandrel shoulder 33. Upward jarring then is used to shear the pin 180 so that the spring 146 relaxes to enable a retraction of the wings 149. Downward jarring is used to release the latch arm 153 from the latch mechanism 34.

When the mandrels 106 and 112 of the orienting section 101 were shifted downward by the spring 104 as previously described, the keys 107 and 113 are pivoted inwardly to inoperative position by the edges 200 of a cover sleeve 201. Thus the keys will not drag as the kickover tool is removed from the tubing.

To remove the kickover tool 101 after having set the valve 129, the tool is first lowered within the mandrel 10. The wings 149 have been retracted as described above, and the coil spring 142 is acting to bias the pivot arm 140 inward. After sufficient lowering, the pivot arm 140 and the running arm 153 are retracted to their running positions alongside the tray 130, and the entire assembly can be withdrawn from the tubing.

To retrieve a flow control device which needs replacement or repair, the same procedure as described above is used except that a conventional pulling arm assembly is substituted for the running arm 153, and downward jarring is used to release the latch mechanism 34.

Since certain changes or modifications may be made in the disclosed embodiment, without departing from the inventive concepts involved, it is the aim of the appended claims to cover all such changes and modifications falling within the true spirit and scope of the present invention.

We claim:

1. A kickover tool apparatus for use in placing and removing flow control devices in and from a side pocket mandrel, comprising: orienting means; tray means connected to the lower end of said orienting means and having inwardly biased kickover means pivotally mounted thereon; said kickover means including normally retracted, laterally shiftable guide means for causing outward pivotal movement of said kickover means when said guide means is shifted outward; said orienting means including upper and lower dog means and means for mounting said dog means in a predetermined angular relationship to one another; and control means coupled to said dog means and responsive to a change in said angular relationship for caming said kickover means outwardly to permit lateral shifting of said normally retracted guide means.

2. The apparatus of claim 1 wherein said control means further includes a compressed spring arranged to urge said dog means downward; and a rod coupled to said dog means and extending along said tray means, said rod and dog means being arranged for downward movement relative to said tray means in response to extension of said spring means.

3. The apparatus of claim 2 further including cam means on said rod representative to said downward movement for partially extending said kickover means to release said guide means.

4. The apparatus of claim 3 wherein said kickover means including an arm having its lower end pivoted to said tray means; and means for biasing the upper end of said arm means inwardly toward said tray means.

5. The apparatus of claim 4 wherein said guide means comprises a pair of wings adapted to be projected from opposite sides of said arm means.

6. The apparatus of claim 5 further including spring means and linkage means for biasing said wings toward their extended positions.

7. The apparatus of claim 6 further including means response to longitudinally directed force for disabling said spring means to thereby enable said wings to move inwardly to retracted positions.

8. The apparatus of claim 7 wherein said arms means comprises upper and lower body sections; means providing a lost—motion connection between said body sections; said force responsive means comprising a shear member attaching said body sections to one another with said connection in an intermediate position.

9. The apparatus of claim 8 wherein said spring means reacts between one of said body sections and said linkage means.

10. The apparatus of claim 1 wherein said orienting means includes a tubular body; upper and lower mandrel means in said body respectively carrying said upper and lower dog means; said control means including a power spring for biasing said mandrel means downwardly; and clutch means for preventing a change in the angular relationship of said dog means until a moment of a predetermined magnitude has been applied thereto.

11. The apparatus of claim 10 wherein said clutch means includes jay-slot means on said upper mandrel means cooperable with pin means on said tubular body, said jay-slot means including an inclined wall section engageable with said pin means and providing a yieldable resistance to relative rotation between said body and said upper mandrel means.

12. The kickover tool apparatus for use in placing and removing flow control devices in and from a side pocket mandrel, comprising: orienting means including a housing, upper and lower outwardly projecting dog means on said housing, said dog means initially having a predetermined angular relationship to one another, and means allowing a change in said angular relationship; tray means connected to said housing and having normally retracted kickover arm means pivotally mounted thereon; laterally shiftable guide means on said kickover arm means movable from an inner retracted position to an outer extended position; means operable in the normally retracted position of said kickover arm means for retaining said guide means in said inner position; and control means responsive to a change in said angular relationship for camming said kickover arm means outward to disable said retaining means and permit said guide means to move said extended position.

13. The apparatus of claim 12 wherein said retaining means includes side surfaces of said tray means arranged to engage said guide means in said inner retracted position thereof to prevent movement to said extended position.

14. The apparatus of claim 13 wherein said control means includes an elongated rod coupled to said dog means and having a cam surface thereon, said cam surface cooperating with a comparison cam surface on said kickover arm means to cause an initial pivotal movement thereof that disengages said guide means from said side surfaces.

15. The apparatus of claim 14 wherein said dog means are movable from an upper position to a lower position relative to said housing; compressed spring means for biasing said dog means toward said lower position; and clutch means for preventing movement of said dog means to said lower position until a change in said angular relationship has occurred.

16. The apparatus of claim 15 wherein said clutch means includes means for preventing release thereof until a torque of a predetermined magnitude is applied to one of said dog means.

17. The apparatus of claim 12 further including compressed spring means tending to shift said guide means to said extended position; and means responsive to a jarring force applied to said kickover arm means for relaxing said spring means to permit said guide means to return to said inner retracted position.

* * * * *